US009659459B2

(12) United States Patent
Phillips et al.

(10) Patent No.: US 9,659,459 B2
(45) Date of Patent: May 23, 2017

(54) GAME SERVER, GAMING SYSTEM AND A GAMING METHOD

(75) Inventors: Gareth Phillips, Manchester (GB); Scott Christopher Olive, Narrabeen (AU); William Patrick Miller, Kew (AU)

(73) Assignee: Aristocrat Technologies Australia Pty Limited, North Ryde, NSW (AU)

( * ) Notice: Subject to any disclaimer, the term of this patent is extended or adjusted under 35 U.S.C. 154(b) by 1430 days.

(21) Appl. No.: 11/780,772

(22) Filed: Jul. 20, 2007

(65) Prior Publication Data

US 2008/0090660 A1 Apr. 17, 2008

(30) Foreign Application Priority Data

Jul. 20, 2006 (AU) ..... 2006903928

(51) Int. Cl.
*G07F 17/32* (2006.01)

(52) U.S. Cl.
CPC ..... *G07F 17/329* (2013.01); *G07F 17/32* (2013.01)

(58) Field of Classification Search
CPC ..... G07F 17/32
USPC ..... 463/16–20
See application file for complete search history.

(56) References Cited

U.S. PATENT DOCUMENTS

| | | | | |
|---|---|---|---|---|
| 6,270,408 | B1 | 8/2001 | Sakamoto et al. | |
| 6,302,794 | B1 | 10/2001 | Ogawa | |
| 6,306,034 | B1 | 10/2001 | Sakamoto et al. | |
| 6,497,617 | B1 | 12/2002 | Yoshida | |
| 6,569,017 | B2 * | 5/2003 | Enzminger et al. | 463/19 |
| 7,235,011 | B2 | 6/2007 | Randall et al. | |
| 7,695,361 | B2 * | 4/2010 | Lind et al. | 463/19 |
| 7,708,633 | B2 * | 5/2010 | Lind et al. | 463/19 |
| 7,731,581 | B2 * | 6/2010 | Chamberlain et al. | 463/19 |
| 2004/0152508 | A1 * | 8/2004 | Lind et al. | 463/19 |
| 2005/0043079 | A1 * | 2/2005 | Huang | 463/19 |
| 2005/0059449 | A1 | 3/2005 | Yarbrough | |
| 2005/0059466 | A1 | 3/2005 | Yarbrough | |
| 2005/0250569 | A1 | 11/2005 | Kane et al. | |
| 2005/0261050 | A1 * | 11/2005 | Waters | 463/19 |
| 2006/0025198 | A1 * | 2/2006 | Gail et al. | 463/19 |
| 2006/0111168 | A1 * | 5/2006 | Nguyen et al. | 463/16 |
| 2006/0121977 | A1 | 6/2006 | Odom | |
| 2006/0205468 | A1 * | 9/2006 | Saffari et al. | 463/16 |
| 2007/0060287 | A1 * | 3/2007 | Reddicks et al. | 463/19 |

* cited by examiner

*Primary Examiner* — Jay Liddle
(74) *Attorney, Agent, or Firm* — Armstrong Teasdale LLP

(57) ABSTRACT

In a first aspect, the invention provides a game server configured to communicate during use with at least one player terminal, each of which is configured to facilitate play of a centrally drawn game, the game server configured to: determine that a win rule of the centrally drawn game has been satisfied; determine a prize corresponding to satisfaction of the win rule; and find a probabilistic game instance having a prize outcome corresponding to the prize, at least in part, by executing one or more probabilistic game instances to attempt to find a probabilistic game instance having a prize outcome corresponding to the prize.

8 Claims, 6 Drawing Sheets

GAME SERVER, GAMING SYSTEM AND A GAMING METHOD

RELATED APPLICATIONS

This application claims priority to an Australian patent application filed on Jul. 20, 2006, as serial number AU2006903928, entitled "Game Server, Gaming System and a Gaming Method." The foregoing application is herein incorporated by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates to a game server, a gaming system and a gaming method.

In the game of bingo, the outcome of the game is governed by the distribution of numbers on the various bingo cards of individual players and the random drawing of those numbers. If bingo is provided electronically, players use individual gaming machines to play, and numbers are drawn randomly and distributed to each participating gaming machine. In order to provide entertainment in a bingo machine, the outcome of the bingo game is sometimes displayed to the player as the outcome of a probabilistic game such as a slot machine game having the same prize. That is, the slot machine game is animated on the game machine in order to award the bingo prize. Prior art techniques for obtaining the outcome of the slot machine game rely on mapping each bingo game outcome to a specific slot game outcome or to stored random number generator seed with known slot game outcomes. These techniques are deterministic in nature and rely on "stored games". These stored games lack the true feeling of chance that is normally obtained by a probabilistic game and are by their nature a mere facsimile.

BRIEF SUMMARY OF THE INVENTION

In a first aspect, the invention provides a game server configured to communicate during use with at least one player terminal, each of which is configured to facilitate play of a centrally drawn game, the game server configured to:

- determine that a win rule of the centrally drawn game has been satisfied;
- determine a prize corresponding to satisfaction of the win rule; and
- find a probabilistic game instance having a prize outcome corresponding to the prize, at least in part, by executing one or more probabilistic game instances to attempt to find a probabilistic game instance having a prize outcome corresponding to the prize.

In an embodiment, the game server is further configured to:

- allocate a plurality of identifiers to each player; and
- obtain random identifiers to be compared to each player's allocated identifiers in accordance with at least one win rule.

In an embodiment allocating identifiers to each player constitutes generating a player entry for each player of the centrally drawn game, each player entry comprising a plurality of identifiers.

In an embodiment the game server is configured to communicate player entries to each participating player terminal.

In an embodiment the game server is arranged such that if the game server fails to find a slot game instance by executing one or more slot game instances, the game server finds a slot game instance by obtaining the slot game instance from a look up table.

In an embodiment the game server determines that it has failed to find a slot game instance by executing slot game instances until a time limit is breached.

In an embodiment the game server is arranged to communicate at least the outcome of a found probabilistic game instance to the player terminal in relation to which the win rule is satisfied for display on the player terminal.

In an embodiment the game server is arranged to run a separate game application for each player terminal that executes the slot game instances.

In an embodiment the game server is arranged to execute each slot game instance on the basis of random numbers obtained from a random number generator (RNG) server.

In an embodiment the game server comprises an identifier draw engine that generates each player entry.

In an embodiment the identifier draw game is a bingo game.

In a second aspect, the invention provides a gaming system comprising:

- at least one player terminal, each player terminal comprising a player interface that allows a player to play an centrally drawn game and a display; and
- a game server in data communication with each player terminal, the game server configured to:
  - determine that a win rule of the centrally drawn game has been satisfied;
  - determine a prize corresponding to satisfaction of the win rule; and
  - find a probabilistic game instance having a prize outcome corresponding to the prize, at least in part, by executing one or more probabilistic game instances to attempt to find a probabilistic game instance having a prize outcome corresponding to the prize; and
  - communicate at least the outcome of the found probabilistic game instance to the player terminal, whereafter the player terminal displays at least the outcome of the probabilistic game instance.

In an embodiment the game server is further configured to:

- allocate a plurality of identifiers to each player; and
- obtain random identifiers to be compared to each player's allocated identifiers in accordance with at least one win rule.

In an embodiment allocating identifiers to each player constitutes generating a player entry for each player of the centrally drawn game, each player entry comprising a plurality of identifiers.

In an embodiment the game server is configured to communicate player entries to each participating player terminal.

In an embodiment the player interface is arranged to allow the player to enter a win claim instruction, the player terminal communicates the win claim instruction to the game server, and the game server is arranged to determine that a win claim instruction has been received as a condition of awarding the prize outcome to the player.

In an embodiment the player enters a win claim instruction by marking a set of identifiers corresponding to a win.

In an embodiment the gaming system comprises a random number generator (RNG) server in data communication with the game server and wherein the game server obtains random numbers from the RNG server and uses the random numbers to obtain the identifiers.

In an embodiment the game server executes each slot game instance on the basis of random numbers obtained form the RNG server.

In an embodiment the game server executes an identifier draw engine that generates each player entry.

In an embodiment the gaming system further comprises a memory .storing a plurality of slot game instances in a look up table, the game server configured such that if the game server fails to find a slot game instance by executing one or more slot game instances, the game server finds a slot game instance by obtaining the slot game instance from a look up table.

In a third aspect, the invention provides a gaming method comprising:

providing a player entry for a centrally drawn game to each player, determining that a win rule of the centrally drawn game has been satisfied;

determining a prize corresponding to satisfaction of the win rule; and finding a probabilistic game instance having a prize outcome corresponding to the prize, at least in part, by executing one or more probabilistic game instances to attempt to find a probabilistic game instance having a prize outcome corresponding to the prize.

In an embodiment each player entry comprises a plurality of allocated identifiers, determining whether a win condition has been satisfied includes obtaining random identifiers to be compared to each player entry in accordance with at least one win rule.

In an embodiment the gaming method comprises obtaining the slot game instance from a look up table if a slot game instance is not found by executing one or more slot game instances.

In a fourth aspect, the invention provides computer program code which when executed by a computer causes the computer to implement the above gaming method comprising:

providing a player entry for a centrally drawn game to each player, determining that a win rule of the centrally drawn game has been satisfied;

determining a prize corresponding to satisfaction of the win rule; and finding a probabilistic game instance having a prize outcome corresponding to the prize, at least in part, by executing one or more probabilistic game instances to attempt to find a probabilistic game instance having a prize outcome corresponding to the prize.

In a fifth aspect, the invention provides a computer readable medium comprising the above computer program code.

Figure 1:
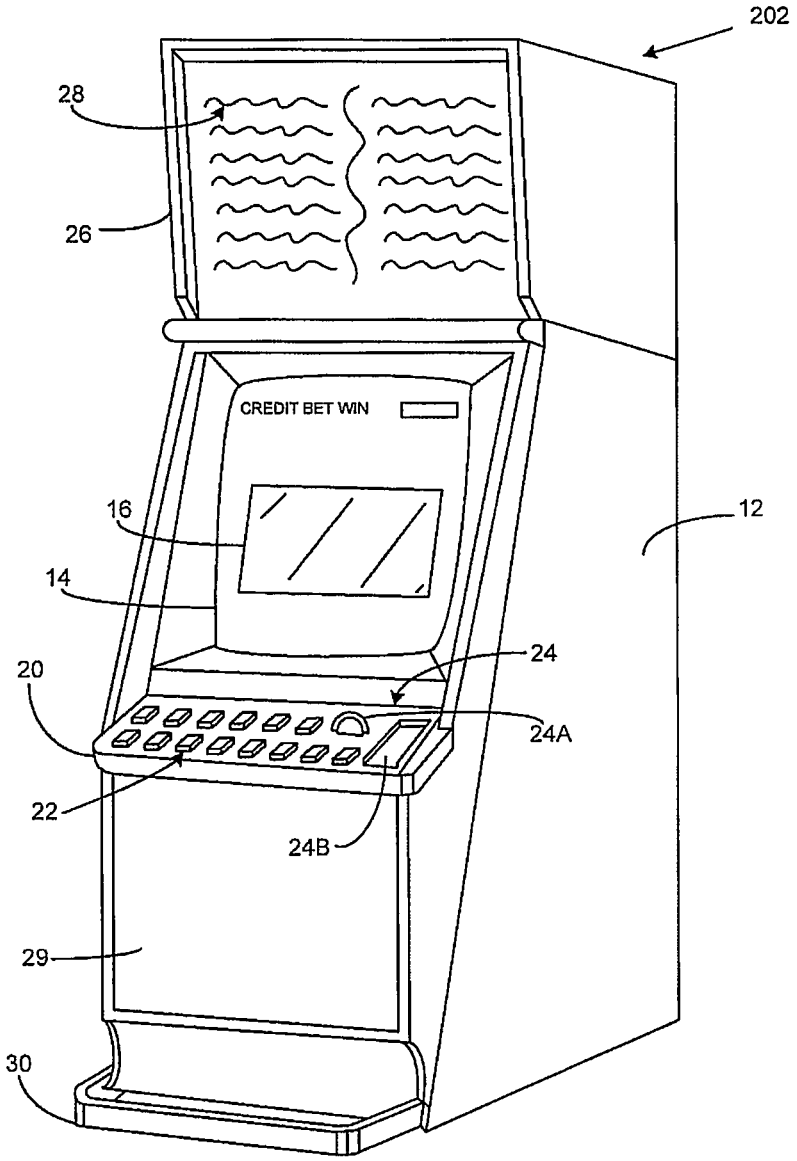
FIG. 1 illustrates a gaming machine that may be used as a player terminal in accordance with an embodiment.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF THE INVENTION

Referring to the drawings, certain embodiments provide a gaming system where there are a plurality of player terminals 202, each of which provides a player interface that allows a player to play a centrally drawn game. A game server 205 is in data communication with each player terminal 202 and executes the centrally drawn game. When a player wins the centrally drawn game, the game server 205 finds an instance of a probabilistic game that has a prize outcome corresponding to the prize of the centrally drawn game. The game server 205 communicates the probabilistic game instance to the player terminal 202 and the player terminal 202 displays this game instance to the player and the prize outcome is awarded to the player.

In an embodiment, the centrally drawn game is bingo. Centrally determined games are also referred to as pre drawn games. An example of another centrally drawn game is Keno.

The probabilistic game of an embodiment is a slot game. Other embodiments may include other probabilistic games such as spinning wheel games and card games.

Centrally determined games involve a random number draw, usually from a fixed set of numbers (e.g. 1 to 100). Numbers are only an example of a convenient way of communicating the result of the draw, and in certain embodiments, letters or symbols may be used to instead of numbers. Herein, the term "identifier" is used to refer collectively to numbers, letters, symbols and the like.

In order to play the game a player operates a player terminal, in this example in the form of a stand alone gaming machine 202 according to an embodiment of the present invention as illustrated in FIG. 1. The gaming machine 202 includes a console 12 having a display 14 on which is displayed representations 16 of a game that can be played by a player. A mid-trim 20 of the gaming machine 202 houses a bank of buttons 22 for enabling a player to interact with the gaming machine, in particular during game play. The mid-trim 20 also houses a credit input mechanism 24 which in this example includes a coin input chute 24A and a bill collector 24B. Other credit input mechanisms may also be employed, for example, a card reader for reading a smart card, debit card or credit card. A reading device (not shown) may also be provided for the purpose of a player tracking device, used as part of a loyalty program. The player tracking device may be provided in the form of a card having a magnetic strip, a smart card, an RFID tag or the like.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 202.

The display 14 shown in FIG. 1 is in the form of a video display unit, particularly a cathode ray tube screen device. Alternatively, the display 14 may be a liquid crystal display, plasma screen, any other suitable video display unit. The top box 26 may also include a display, for example a video display unit, which may be of the same type as the display 14, or of a different type.

Figure 2:
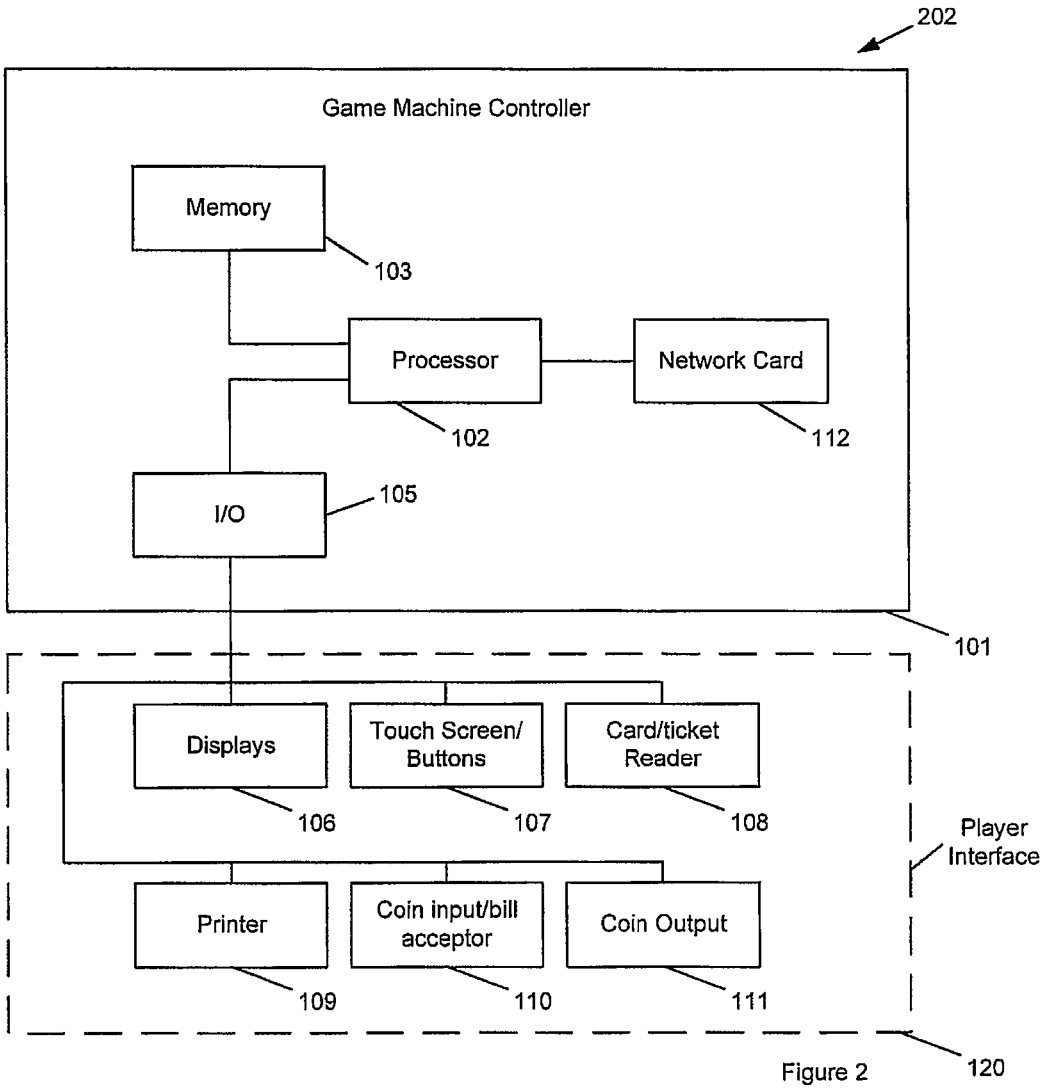
FIG. 2 illustrates schematically details of the gaming machine of FIG. 1.

FIG. 2 shows a block diagram of operative components of the gaming machine 202 according to an embodiment. The gaming machine 202 includes a game machine controller 101 having a processor 102. Instructions and data to control operation of the processor 102 are stored in a memory 103, which is in data communication with the processor 102. Typically, the gaming machine 202 will include both volatile and non-volatile memory and more than one of each type of memory, with such memories being collectively represented by the memory 103. In an embodiment, the gaming machine controller has limited functionality as most processing is carried out on game server 205. The game machine controller's 101 main task is to output game graphics to display 106 of the player interface 120. Game instructions made by the player using a game instruction input mechanism are sent to the game server 205 for processing by the game server 205. Herein the term "processor" is used to refer generically to any device that can implement these tasks and may include: a microprocessor, microcontroller, programmable logic device or other computational device, a general purpose computer (e.g. a PC) or a server.

An input/output (I/O) interface 105 is provided for communicating with peripheral devices of the gaming machine 202. The input/output interface 105 and/or the peripheral devices may be intelligent devices with their own memory for storing associated instructions and data for use with the input/output interface or the peripheral devices.

Figure 3:
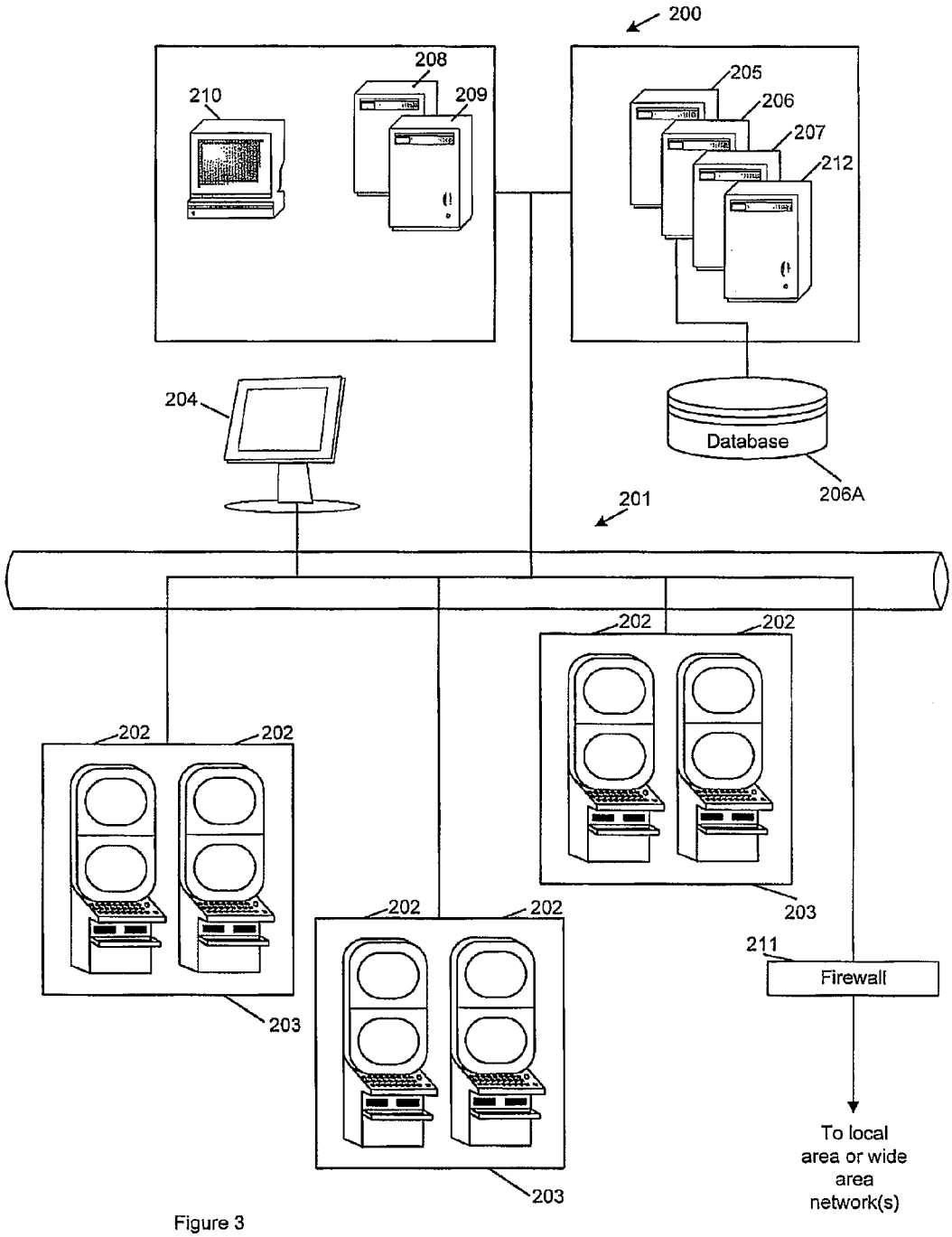
FIG. 3 illustrates the gaming system in accordance with an embodiment.

In the example embodiment shown in FIG. 3, the peripheral devices that communicate with the controller 101 comprise one or more displays 106, a game instruction input mechanism in the form of a touch screen and/or buttons 107, a card and/or ticket reader 108, a printer 109, a bill acceptor and/or coin input mechanism 110 and a coin output mechanism 111 all of which form the player interface 120 that enables the player to enter and play the game. Additional hardware may be included as part of the gaming machine 202, or hardware may be omitted as required for the specific implementation.

In addition, the gaming machine 202 has a communications interface, for example a network card 112. The network card sends game instructions entered by the player to the game server 205.

FIG. 3 shows the gaming system 200 of which the gaming machines form a part according to an embodiment. The gaming system 200 includes a network 201, which for example may be an WAN or LAN. Gaming machines 202, shown arranged in three banks 203 of two gaming devices 202 in FIG. 3, are connected to the network 201. The gaming machines 202 provide a player operable interface as shown in more detail in FIGS. 1 and 2. While banks 203 of two gaming machines 202 are illustrated in FIG. 3, banks of one, three or more gaming machines 202 are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

On receipt of game instructions from a gaming machine 202, a game server 205 implements the game played by a player using a gaming machine 202 as described in further detail below. The game server 205 obtains random numbers required for the game from a random number server 212. Random number server 212 typically implements a pseudo random number generation scheme of sufficient complexity that the numbers exhibit statistical randomness. Other random number generators may also be employed, for example true random number generators. In addition to the above, a database management server 206 may manage storage of game programs and associated data for downloading or access by the gaming devices 202 in a database 206A. If the gaming system enables players to participate in a Jackpot game, a Jackpot server 207 will be provided to monitor and carry out the Jackpot game.

Figure 4:
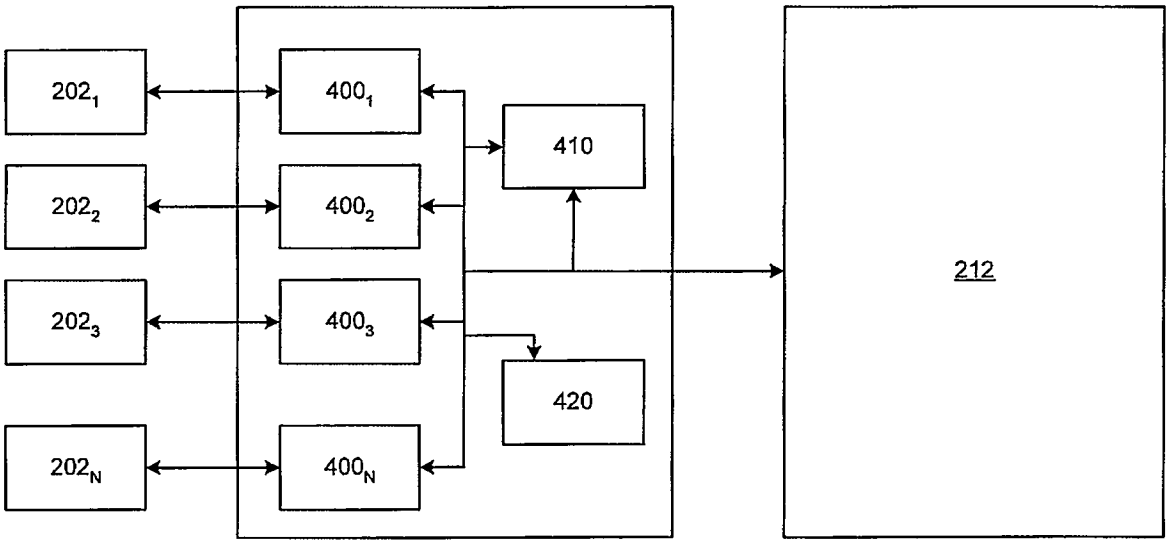
FIG. 4 is a schematic diagram of a gaming system according to an embodiment.

Players use the gaming machines 202 to enter the bingo game. For every player who enters the bingo game, a corresponding game application 400-400N is created at the server 205. The game application obtains game entries in the form of electronic bingo cards from a bingo engine 410 also running on the game server 205. As illustrated in FIG. 4 there will be N game applications 400 all in communication with bingo engine 410, where N is the number of players at any time. Typically there will be a single player using each game machine 202. Accordingly, there will be N player terminals 2021 to 202N, each in data communication with the game server 205. The bingo cards are populated and distributed to the game applications 400 by the bingo engine 410 in line with the rules for that particular bingo game. The bingo cards of individual players are displayed on the players' game machines 202. Such cards normally comprise a grid having player allocated numbers thereon (e.g. 20 numbers). The numbers are distributed throughout the grid. There may be rules as to how many numbers may or must be selected for an individual line or the selection may be entirely random. A player may win in accordance with a number of different win rules. The win rules may include, for example, a win rule for completing a row, a column or the entire card by matching balls (e.g. numbers) against the card as they are drawn by the game.

Figure 5:
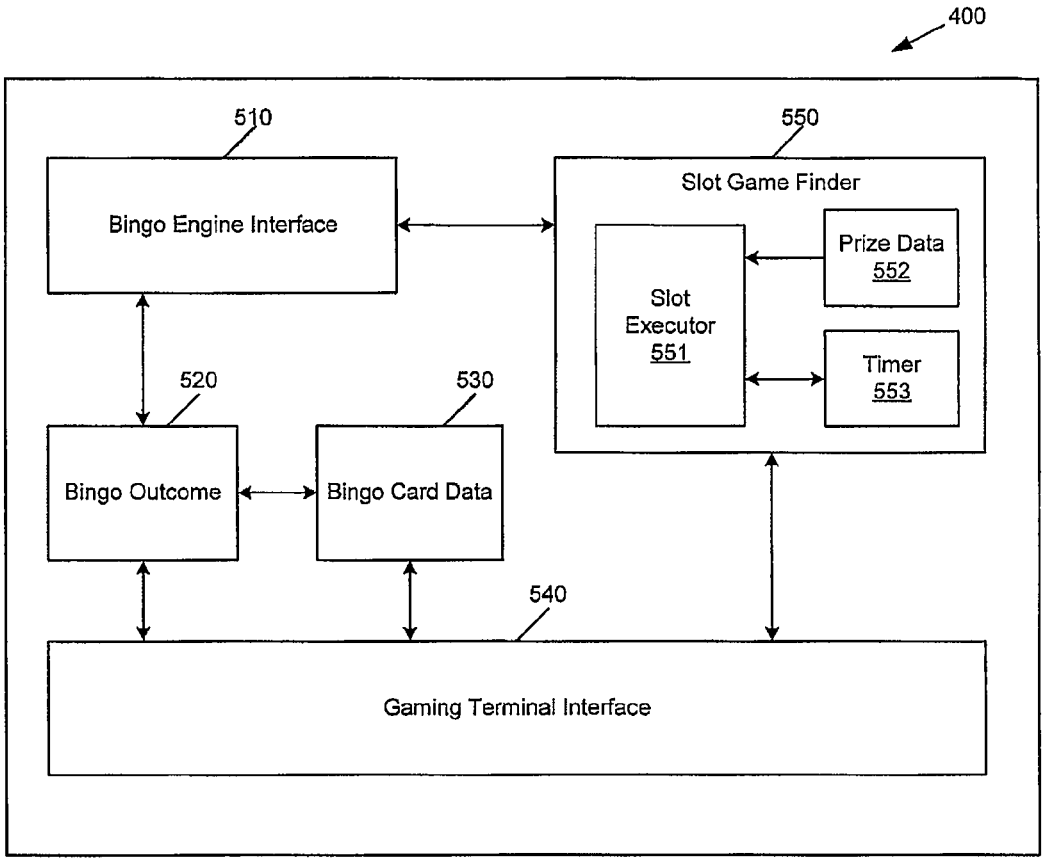
FIG. 5 is a block diagram illustrating modules of a game application according to an embodiment.

As illustrated in the embodiments shown in FIGS. 4 and 5, the bingo engine 410 is in communication with the random number generator server 212 which supplies random numbers to the bingo engine 410. The bingo engine 410 uses this number to randomly draw bingo balls. For example, if the random number generator produces a value between 0 to 1, the range of 0 to 1 may be divided evenly into sub ranges each of which correspond to an individual number of the set of numbers of the bingo game so as to give equal probability of each number being drawn. These drawn bingo balls are distributed to all the game applications 400 via Bingo engine Interface 510. The game applications transmit data to the individual player terminals 202 corresponding to the drawn number or "balls" via the gaming terminal interface 540. The game machine controller 101 of the game machine 100 displays the player's card and the drawn numbers to be displayed on a display so that a player can see whether the numbers are "covering" their bingo card. In a variation, the numbers may be displayed separately from the card and the player may be required to "mark" their card, for example, by touching the screen when a drawn number corresponds to their card.

At some point, a Bingo outcome module 520 will determine that one or more cards specified by bingo card data 530 will have been covered by sufficient numbers to satisfy a win rule and hence a prize should be awarded. The prize can be awarded in one of two different ways. In a first embodiment, Bingo outcome module 520 of the game application 400 determines the card that has been covered and automatically sends data to the bingo engine 410 via Bingo engine interface 510 indicating that it has a winning combination. In an alternative embodiment, a player may be required to make an input of a win claim instruction to inform the game application that the player has a winning sequence, for example by pressing a button 24 on the game machine 10 and the game application does not send data indicating that a winning combination has been covered to the bingo engine 410 until it receives the game play instruction. In another embodiment, the application sends a win claim instruction based on a player's "marking" of their card.

After the game application 400 has advised the bingo engine 410 of the winning combination, the bingo engine 410 sends data to the relevant game application indicating the prize amount associated with the win rule that has been satisfied. The Bingo engine interface passes the prize data to a slot game finder module 550.

A slot executor module 557 of the game application 400 then executes a slot game using random number values obtained from the RNG server 212. The slot game has a particular pay table 552 and return to player associated with it. The slot executor 551 of game application 400 compares the outcome of the slot game with the prize amount. If the prize outcome corresponds to the prize amount from the bingo game, for example by being the same as the prize from the bingo game or within an acceptable tolerance of the bingo prize amount, the game application 400 provides the outcome and typically the graphics sequence corresponding to that particular slot game instance to the player's game machine 202 to cause the game machine 202 to display a game corresponding to that slot game instance to thereby award a prize to the player. If there is no match, the game application 400 continues to execute slot game instances using different random number values obtained from the random number server 212. The game application 400 can execute a huge number of slot game instances in a small fraction of time.

The game application 400 is configured to continue to execute the slot games until either an appropriate slot prize is found that corresponds to the bingo prize, or a fixed time has passed as monitored by timer 552. If a fixed time has passed, the game application 400 looks up a winning game sequence for that slot game in look up table 420 that gives a prize that corresponds to the bingo win. In this way, the search for a probabilistic solution is only allowed to continue for a finite time before a table look up method is enforced. In another embodiment the slot executor 551 may only execute a fixed number of slot game instances.

Figure 6:
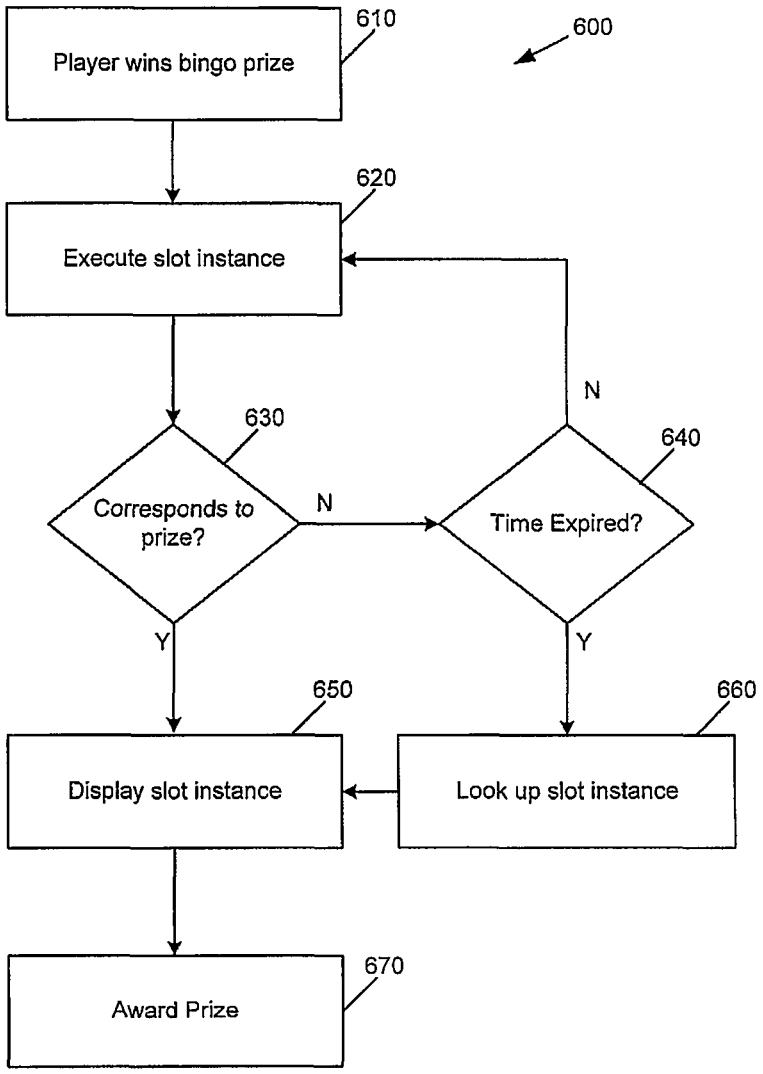
FIG. 6 is a flow chart of an embodiment.

A method 600 of an embodiment is shown in FIG. 6. When a player wins a bingo prize 610, the gaming machines begins executing slot instances 620. The method involves determining if the slot instance has a prize outcome that corresponds to the prize 630 if the answer is no, the method involves determining whether the time has expired 640 and if it has not expired, executing a further slot instance 620. Accordingly, it will be appreciated that the method loops until either a slot instance corresponding to the prize is found, in which case this slot instance is displayed 650 to the player, or the time expires, in which case the slot instance finder module of the software looks up a slot instance 660 which is displayed 650 and the prize is awarded 670.

The above embodiment has been described in relation to a series of software modules executed on a gaming server. However, a person skilled in the art will appreciate that an alternative embodiments that some modules could be embodied in hardware or partly in software and hardware. For example, the random number generator may use a random number generation circuit.

A person skilled in the art will also appreciate that unless explicitly described otherwise, references to random number generation herein include both true random number generation and pseudo random number generation.

The advantage of using this method is that in the instances where it is possible to locate an appropriate slot game instance, the game is more entertaining in that it provides real game outcomes.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

In certain embodiments, in accordance with known techniques, functionality at the server side of the network may be distributed over a plurality of different computers. For example, elements may be run as a single "engine" on one server or a separate server may be provided. For example, the game server 205 could run a random generator engine instead of a separate random number generator server being provided. Further, in certain embodiments, a plurality of games servers could be provided to run different games or a single game server may run a plurality of different games as required by the terminals.

These and other variations will be apparent to persons skilled in the art and should be understood as falling within the scope of the invention described herein.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A game server configured to communicate with at least one gaming machine configured to facilitate play of a centrally drawn bingo game having a win rule, the game server comprising a processor configured to:

provide an electronic bingo card to the gaming machine in exchange for a credit input received at the gaming machine through at least one of a coin input mechanism and a bill acceptor;

determine a bingo prize for the electronic bingo card when the electronic bingo card satisfies the win rule for the centrally drawn bingo game;

initiate execution of a plurality of probabilistic game instances in response to determining the bingo prize, each of the probabilistic game instances having a corresponding probabilistic prize;

compare a first corresponding probabilistic prize of a first probabilistic game instance, of the plurality of probabilistic game instances, to the bingo prize;

execute a second probabilistic game instance, of the plurality of probabilistic game instances, upon determining the bingo prize does not match the first corresponding probabilistic prize;

compare a last corresponding probabilistic prize of a last probabilistic game instance, of the plurality of probabilistic game instances, to the bingo prize;

transmit game data representing the last probabilistic game instance to the gaming machine for display upon determining the bingo prize matches the last corresponding probabilistic prize;

terminate execution of the plurality of probabilistic game instances upon determination the bingo prize matches the last corresponding probabilistic prize; and instruct the gaming machine to award the last corresponding probabilistic prize upon determining the bingo prize matches the last corresponding probabilistic prize.

2. A game server as claimed in claim 1 wherein the game server is further configured to run a separate game application that executes the plurality of probabilistic game instances.

3. A game server as claimed in claim 1 further configured to execute each probabilistic game instance, of the plurality of probabilistic game instances, on the basis of random numbers obtained from a random number generator (RNG) server.

4. A gaming system comprising:

a plurality of gaming machines, each gaming machine of the plurality of gaming machines comprising a) a player interface that facilitates play of a centrally drawn bingo game having a win rule, b) at least one of a coin input mechanism and a bill acceptor configured to receive credit input in exchange for entry to the centrally drawn bingo game, and c) a display configured to display a probabilistic game instance; and a game server in data communication with a gaming machine of the plurality of gaming machines, the game server configured to:

provide an electronic bingo card to the gaming machine in exchange for the credit input received at the gaming machine;

determine a bingo prize for the electronic bingo card when the electronic bingo card satisfies the win rule for the centrally drawn bingo game;

initiate execution of a plurality of probabilistic game instances in response to determining the bingo prize, each of the probabilistic game instances having a corresponding probabilistic prize;

compare a first corresponding probabilistic prize of a first probabilistic game instance, of the plurality of probabilistic game instances, to the bingo prize;

execute a second probabilistic game instance, of the plurality of probabilistic game instances, upon determining the bingo prize does not match the first corresponding probabilistic prize;

compare a last corresponding probabilistic prize of a last probabilistic game instance, of the plurality of probabilistic game instances, to the bingo prize;

transmit game data representing the last probabilistic game instance to the gaming machine for display upon determining the bingo prize matches the last corresponding probabilistic prize;

terminate execution of the plurality of probabilistic game instances upon determination the bingo prize matches the last corresponding probabilistic prize; and instruct the gaming machine to award the last corresponding probabilistic prize upon determining the bingo prize matches the last corresponding probabilistic prize.

5. A gaming system as claimed in claim 4, wherein the player interface is configured to allow a player to enter a win claim instruction, the gaming machine communicates the win claim instruction to the game server, and the game server is configured to determine that a win claim instruction has been received as a condition of awarding the bingo prize amount.

6. A gaming system as claimed in claim 4 comprising a random number generator (RNG) server in data communication with the game server and wherein the game server obtains random numbers from the RNG server.

7. A gaming system as claimed in claim 6 the game server executes each probabilistic game instance, of the plurality of probabilistic game instances, on the basis of random numbers obtained from the RNG server.

8. A gaming method of conducting a centrally drawn bingo game having a win rule, the method comprising:

receiving a credit input at a gaming machine using at least one of a coin input mechanism and a bill acceptor in exchange for entry to the centrally drawn bingo game;

providing an electronic bingo card for the centrally drawn bingo game with entry to the centrally drawn bingo game;

determining a bingo prize for the electronic bingo card when the electronic bingo card satisfies the win rule for the centrally drawn bingo game;

initiating execution of a plurality of probabilistic game instances in response to determining the bingo prize, each of the probabilistic game instances having a corresponding probabilistic prize;

comparing a first corresponding probabilistic prize of a first probabilistic game instance, of the plurality of probabilistic game instances, to the bingo prize;

executing a second probabilistic game instance, of the plurality of probabilistic game instances, upon determining the bingo prize does not match the first corresponding probabilistic prize;

comparing a last corresponding probabilistic prize of a last probabilistic game instance, of the plurality of probabilistic game instances, to the bingo prize;

transmitting game data representing the last probabilistic game instance to the gaming machine for display upon determining the bingo prize matches the last corresponding probabilistic prize;

terminating execution of the plurality of probabilistic game instances upon determination the bingo prize matches the last corresponding probabilistic prize; and instructing the gaming machine to award the last corresponding probabilistic prize upon determining the bingo prize matches the last corresponding probabilistic prize.

* * * * *